US006132559A

United States Patent [19]

Haavanlammi et al.

[11] Patent Number: 6,132,559

[45] Date of Patent: Oct. 17, 2000

[54] METHOD AND DEVICE FOR DEWATERING A PAPER OR BOARD WEB AND PASSING THE WEB INTO A PRESS SECTION

[75] Inventors: Arto Haavanlammi; Ari Puurtinen; Mika Viertola, all of Jyväskylä, Finland

[73] Assignee: Valmet Corporation, Helsinki, Finland

[21] Appl. No.: 09/053,576

[22] Filed: Apr. 2, 1998

[30] Foreign Application Priority Data

Apr. 2, 1997 [FI] Finland ..... 971346

[51] Int. Cl.[7] ..... D21F 2/00; D21F 3/02

[52] U.S. Cl. ..... 162/203; 162/210; 162/217; 162/306; 162/360.2

[58] Field of Search ..... 162/203, 301, 162/305, 306, 210, 205, 360.2

[56] References Cited

U.S. PATENT DOCUMENTS

| | | | |
|---|---|---|---|
| 5,034,100 | 7/1991 | Sides | 162/306 |
| 5,389,206 | 2/1995 | Buck et al. | 162/301 |
| 5,466,342 | 11/1995 | Kankaanpaa | 162/301 |
| 5,468,349 | 11/1995 | Schiel | 162/358.3 |
| 5,501,775 | 3/1996 | Kotitschke et al. | 162/360.3 |
| 5,540,817 | 7/1996 | Schiel | 162/203 |
| 5,792,320 | 8/1998 | Kaasalainen et al. | 162/360.2 |

FOREIGN PATENT DOCUMENTS

| | | |
|---|---|---|
| 4321399 | 11/1993 | Germany . |
| 4321406 | 11/1993 | Germany . |
| 4301750 | 7/1994 | Germany . |
| 4301751 | 7/1994 | Germany . |

*Primary Examiner*—Karen M. Hastings
*Attorney, Agent, or Firm*—Steinberg & Raskin, P.C.

[57] ABSTRACT

A method and device for dewatering a paper or board web and passing the web as a closed draw from a lower wire of a web forming section, in which the web is formed between the lower wire and an upper wire, to the press section and through one or more dewatering press nips in the press section. The web is separated from the upper wire on a first suction zone or block of the suction roll, after which the web is affixed to the lower wire over a second suction zone or block of the suction roll. The web is then affixed, in a pre-press and transfer nip formed by the suction roll and a smooth-faced roll, onto the outer face of a substantially non-watering-receiving transfer belt, the web being passed on support of this belt into the first press nip. In the press nip, water is pressed out of the web into a water-receiving press felt.

12 Claims, 2 Drawing Sheets

METHOD AND DEVICE FOR DEWATERING A PAPER OR BOARD WEB AND PASSING THE WEB INTO A PRESS SECTION

FIELD OF THE INVENTION

The present invention related to a method for dewatering a paper or board web and passing the web as a closed draw from a lower wire of a web forming section, the web being formed in the forming section between the lower wire and an upper wire, to a press section and through one or more dewatering press nips in the press section.

The present invention also relates to a press section for a paper or board machine including successively arranged press zones, and a paper or board machine including such as press section. The web is transferred into a first press zone in a running direction as a closed draw from a lower wire of a preceding web former section, in which the web is formed between the lower wire and an upper wire, and is transferred between the different zones in the press section as a supported and closed draw. After the last press zone, the web is transferred into a dryer section as a closed draw.

BACKGROUND OF THE INVENTION

Constantly increasing running speeds of paper and board machines provide new problems to be solves, mostly related to runnability of a web through the paper or board machine. With the present paper machine running speeds of about 25 meters per second, closed press sections, which comprise a compact combination of press rolls fitted around a smooth-faced center roll, still operate satisfactorily, but with the future running speeds of 25 meters per second to about 40 meters per second, new press section constructions are needed.

From the point of view of energy economy, dewatering of a web taking place by pressing is preferable to dewatering taking place by evaporation. The more water can be removed from the web by pressing, e.g., in press nips, the less water that has to be removed by evaporation. When the machine speed is increased, the nip times become shorter, in which connection it would be necessary to increase the compression pressure accordingly in order that the press impulse would remain unchanged. The peak pressure of pressing in the press nips can only be increased up to a certain limit, after which the structure of the web is broken.

In the prior art, a number of different press section constructions are known for removing water out of a paper or board web and for passing the web from the web forming section to the press section. In the following, some of them will be described.

The current assignee's Finnish Patent Application No. 954698 (U.S Pat. No. 5,792,320) most closely related to the present invention. In this patent application, a construction is suggested for removing water out of a paper or board web and for passing the web as a closed draw from the forming wire or transfer wire of the web former to the press section and through one or several dewatering press nips in the press section. The web that runs on the forming wire or on the transfer wire is made to adhere, in a transfer and pre-press zone, to the outside face of a substantially non-water-receiving transfer belt and after the pre-press zone, the web is separated substantially immediately from the forming or transfer wire and passed on support of the transfer-belt loop onto the next press fabric in the press section and/or into the press nip.

In the embodiment shown in FIG. 8 in the current assignee's Finnish Patent Application No 954698, there is a first pre-press zone between a first smooth-faced upper roll and an open-faced lower roll. Moreover, there is a second pre-press nip between a second smooth-faced press roll and the open-faced lower roll. In the second pre-press nip, the web is separated from the open-faced lower roll and made to adhere to the outer face of the transfer felt that is impermeable to water. From the face of the transfer belt, the web is passed further into the press unit between a transfer belt and a lower felt.

In German Patent Application No. DE 43 01 750 A1 (Voith) (corresponding to U.S. Pat. No. 5,501,775), a construction is suggested for dewatering a web formed on an endless wire, wherein the web is passed into a first press nip, which is formed between the wire, which is in contact with the web from below, and a first smooth-faced press roll, after which the web is passed into a second press nip. The second press nip is formed substantially in the horizontal plane between the first smooth-faced press roll and a felt. After the second press nip, the web is passed into a third press nip formed between the first smooth-faced press roll, which is in contact with the upper face of the web, and a second smooth-faced roll. The second press nip consists of a shoe press. In this application, in FIG. 4, a construction is illustrated in which the first press nip is formed directly between a suction roll of the wire unit and the first smooth-faced press roll. For the transfer of the web, a transfer belt is not employed, but the transfer takes place on the face of a smooth-faced roll.

In the construction described in German Patent Application No. DE 43 01 751 A1 (Voith) (corresponding to U.S. Pat. No. 5,540,817), the web is formed between a lower wire and an upper wire, in which connection the web and the upper wire are separated momentarily by means of a difference in pressure from the lower wire before the web is transferred into the press unit. In this application, the transfer of the web into the press unit, in the embodiment shown in FIG. 2, has been accomplished so that the first press nip is formed directly between a suction roll of the wire unit and a first smooth-faced press roll. In this manner, the web is separated from the upper wire on the suction zone of the suction roll of the wire unit. A transfer belt is not employed, but the transfer takes place on the face of a smooth-faced roll.

In German Patent Application No. 43 21 399 A1 (Voith), a construction is described in which there is a transfer of the web taking place from a wire or felt, at least one shoe press following directly after the transfer of the web, and one press felt running through the first press nip. An endless transfer belt impermeable to water is used for the transfer of the web. In the transfer of the web, pre-pressing taking place between two rolls is not employed.

In German Patent Application No. 43 21 406 A1 (Voith) (corresponding to U.S. Pat. No. 5,468,349), a construction of a press section is described in which there are several press nips formed between press rolls and backup rolls and a transfer belt that is impermeable to water and that has a closed, smooth upper face and forms and endless loop, which loop always runs around one press roll in each of two successive press nips. The first two press rolls that remain inside a loop, together with their backup rolls or shoe units, form the first two press nips in the press section, and of the first and the second press roll, the transfer felt runs around at least one of these rolls over a distance of at least 90°. In the transfer of the web, pre-pressing taking place between two rolls is not employed.

OBJECTS AND SUMMARY OF THE INVENTION

It is an object of the present invention to provide new and improved methods and devices for dewatering a paper or board web and passing the web into a press section of a paper or board machine in which it is possible to increase the running speeds of the paper and board machine.

It is another object of the present invention to provide new and improved methods and devices for dewatering a paper or board web and passing the web into a press section in which it is possible to reduce the consumption of energy without deterioration of the quality properties of the web.

It is another object of the present invention to provide new and improved methods and devices for dewatering a paper or board web and passing the web into a press section which are improvements over the prior art constructions described above.

It is still another object of the present invention to provide new and improved methods and devices for dewatering a paper or board web and passing the web into a press section in which it is possible to reduce the number of flat suction boxes in the web former. As a result of this reduction, the friction produced by the suction boxes and abrading the wire becomes lower, and the services life of the wire becomes longer.

It is yet another object of the present invention to provide new and improved paper and board machines which overcome the drawbacks of the prior art paper and board machines.

In order to achieve the objects set forth above, the other, the method for dewatering a paper or board web and passing the web from a lower wire of a web forming section to the press section and through at least one press nip in the press section comprises the steps of forming a pre-press and transfer nip between a suction roll situation in a loop of the lower wire and a smooth-faced press roll, carrying the web on the lower wire over the suction roll into the pre-press and transfer nip and guiding a non-water-receiving transfer belt into the through the pre-press and transfer nip. The smooth faced press roll is situation in a loop of the transfer belt. Thereafter, the web is transferred from the lower wire to the transfer belt in the pre-press and transfer nip and carried on the transfer belt into a first one of that at least one press nip in the press section. A water-receiving press felt is guided into the first press nip and into contact with the web such that water is pressed out of the web into the water-receiving press felt in the first press nip. The web may be formed in the web forming section between the lower wire and an upper wire. The suction roll may include first and second suction zone whereby the upper wire is separated from the web at a location about the first suction zone such that the web is carried on only the lower wire after the upper wire is separated from the web and about the second suction zone. The transfer belt may be guided into contact with the web as the web runs over the second suction zone. The pre-press and transfer nip is constructed such that a substantial amount of water is drained from the web primarily in one direction only through the lower wire into the suction roll and at the same time, the web is affixed reliably to an outer face of the transfer belt.

In some embodiments, when the suction roll includes one or more suction zones, water is drained from the web in the suction zone(s) and in the pre-press and transfer nip until the dry solids content of the web is from about 20% to about 30%. also in this case, the transfer belt is guided into contact with the web as the web runs over one of the suction zone(s).

In certain embodiments, the radius of the suction roll and the radius of the smooth-faced press roll and selected such that the radius of the smooth-faced press roll is smaller than the radius of the suction roll and a ratio of the radius of the suction roll to the radius of the smooth-faced press rolls is from 2 to 5.

The press section of a paper or board machine in accordance with the invention includes at least one press nip for dewatering a web, the web being transferred into a first press nip as a closed draw from a lower wire of the web former section, between adjacent press nips as a supported and closed draw, and from the press section to a subsequently arranged dryer section as a closed draw. The press section includes a pre-press and transfer nip defined by a suction roll arranged in a loop of the lower wire and a smooth-faced press roll whereby the web is carried on the lower wire over the suction roll into the pre-press and transfer nip. A substantially non-water-receiving transfer belt having an outer face to which the web is adherable is guided into and through the pre-press and transfer nip such that the web is transferred from the lower wire onto the outer face of the transfer belt in the pre-press and transfer nip and separates from the lower wire after the pre-press and transfer nip to avoid rewetting of the web. The web is then carried on the transfer belt into the through the first press nip in the press section.

The paper or board machine in accordance with the invention includes the press section described herein, a web former section including means for forming a web between upper and lower wires and a dryer section arranged after the press section for drying the web.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
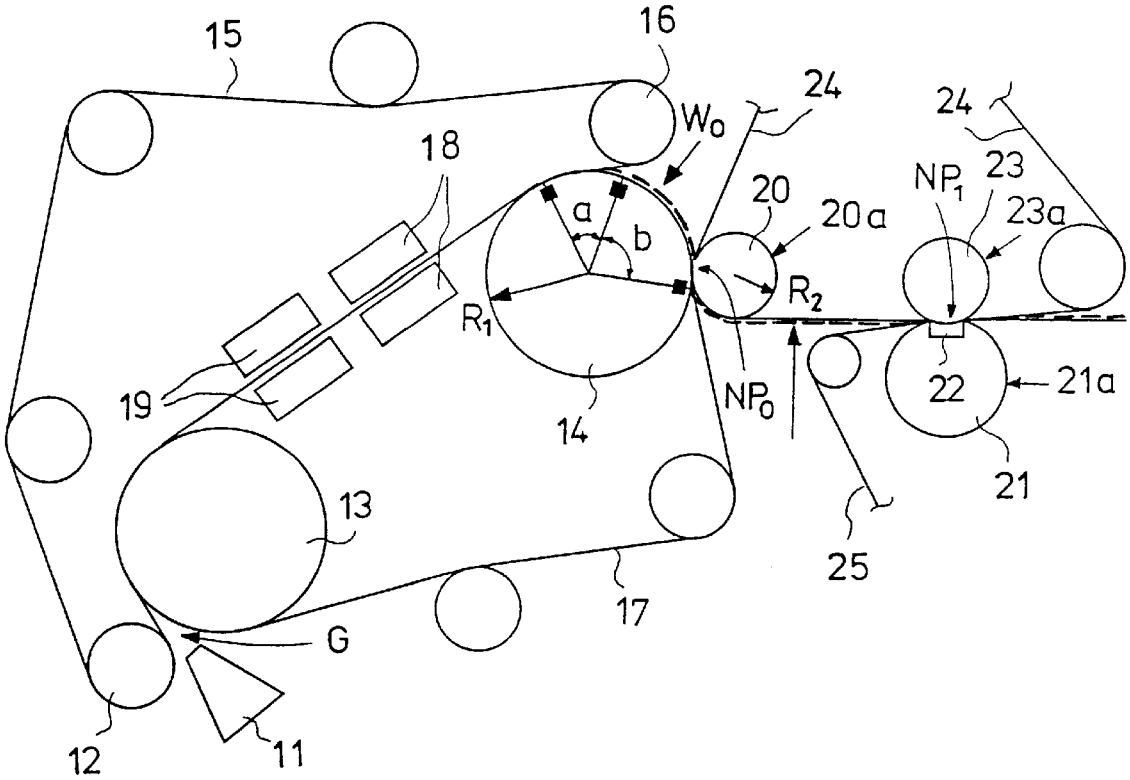
FIG. 1 is a schematic illustration of the wet end of a paper machine and of the initial end of the press section in accordance with the invention.

Referring to the accompanying drawings wherein like reference numerals refer to the same or similar elements, FIG. 1 is a schematic illustration of a twin-wire gap former in a paper machine, comprising a lower wire 17 and an upper wire 15. A headbox 11 of the paper machine feeds stock suspension into a forming gap G defined by the upper and lower wires 15, 17. The forming gap G is defined between the runs of the wires 15, 17, specifically, by the run of the upper wire 15 after it runs over a breast roll 12 placed inside the loop of the upper wire 15 and by the run of the lower wire 17 as it runs over a forming-suction roll 13 placed inside the loop of the lower wire 17. After the curved twin-wire forming zone formed about the forming-suction roll 13, there follows a zone provided with suction boxes 18, 19 in opposed relationship, i.e., on both sides of a straight portion of the twin-wire zone. At the end of the twin-wire zone, there is a reversing roll 16 arranged in a loop of the upper wire 15 and a suction roll 14 arranged in a loop of the lower wire 17. The suction roll 14 includes at least one suction zone, preferably two separate suction zones or blocks a and b, whose vacuum levels can be regulated independently from one another. On the first suction zone a of the suction roll 14, the web $W_0$ is made to adhere to the outer face of the lower wire 17. A transfer belt 24 receives the web from the lower wire 17 and comes into contact with the web runs on the lower wire 17 over the face of the suction roll 14. The suction roll 14 may also include three separate suction zones.

In the other respects, the wet end of the press section involves gap former technology in itself known, which will not be described in more detail in this connection. From the point of view of the invention, the type/construction of the wet end in itself has no decisive significance, and, in principle, the invention can be applied both in a paper machine and in a board machine. In the end of the wet end, there must, however, be a suction roll 14 provided with at least one suction zone, at which roll a pre-press and transfer nip $NP_0$ can be formed by means of a backup roll 20.

After the twin-wire zone, the dry solids content ko of the web $W_0$ is, depending on the paper grade, generally from about 10% to about 20%.

Figure 2:
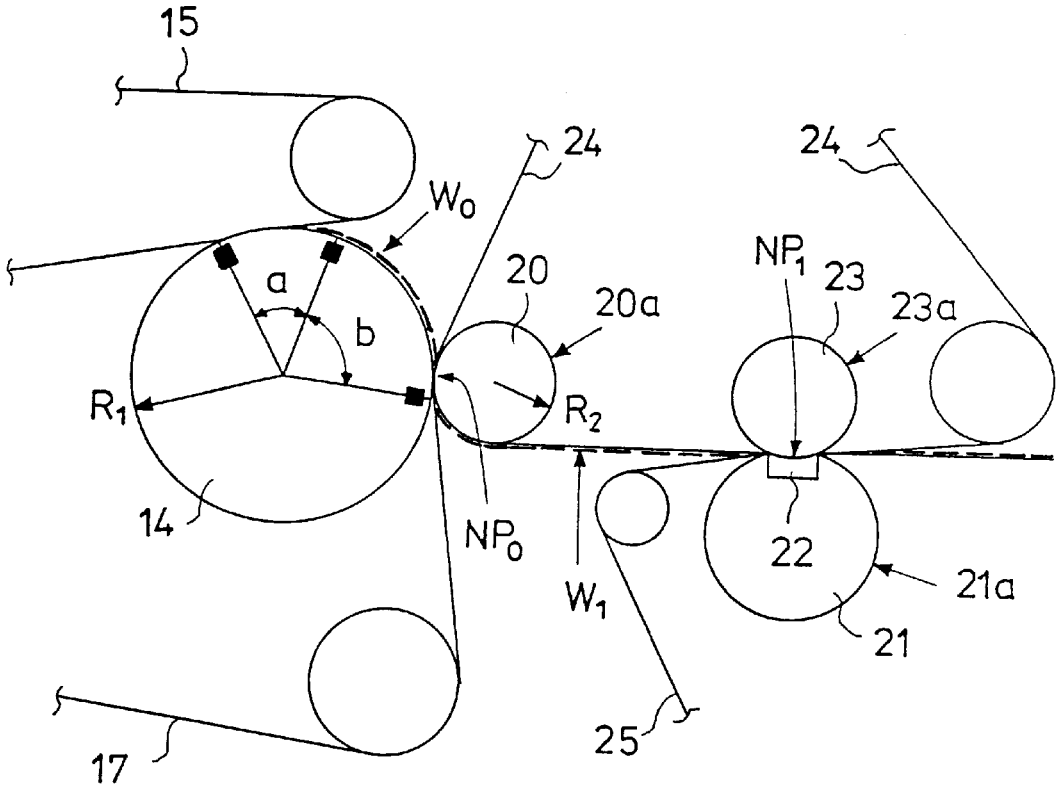
FIG. 2 is a schematic enlarged illustration of the transfer of the web in accordance with the invention from the wet end of the paper machine to the initial end of the press section.

FIG. 2 illustrates the pre-pressing of the web ($W_0$) and the transfer of the web into the press section. In the initial end of the press section, there is a pre-press or backup roll 20, which forms a pre-press and transfer nip $NP_0$ with the suction roll 14 of the web former. The pre-press roll 20 is preferably a solid-mantle roll having a smooth-face 20*a* and whose radius $R_2$ is considerably smaller than the radius $R_1$ of the suction roll 14 of the web former. The ratio of the radii $R_1/R_2$is preferably about 2 to about 5. The transfer belt 24 imposes a requirement of minimum diameter on the pre-press roll 20, which minimum diameter is about 500 mm. If necessary, the outer mantle of the pre-press roll 20 can also be made of a resilient material. After the pre-press and transfer nip $NP_0$, there follows the first press zone $NP_1$ proper, which is an extended-nip zone and is formed between a shoe press roll 21 and a backup roll 23. In the extended nip $NP_1$, above the web W, there is a substantially non-water-receiving transfer belt 24 and below the web $W_1$, there is a water-receiving press felt 25.

In the pre-press and transfer nip $NP_0$, considerable amounts of water are transferred from the paper web $W_0$, with the aid of the vacuum in the latter suction zone b in the suction roll 14, through the lower wire 17 in one direction into the latter suction zone b in the suction roll 14 of the web former. In the pre-press and transfer nip $NP_0$, the web $W_0$ is also made to adhere to the smooth outer face of the transfer belt 24 and passed on support of the transfer belt 24 into the first press zone $NP_1$, After the web $W_0$ has been made to adhere to the outer face of the transfer belt 24 in the pre-press and transfer nip $NP_0$, the web $W_1$ is first turned substantially to the horizontal plane while following the curve radius $R_2$ of the outer face 20*a* of the pre-press roll 20. Thereafter, the web $W_1$ is transferred substantially in the horizontal plane on support of the outer face of the transfer belt 24 into the first press zone $NP_1$.

The first suction zone a on the suction roll 14 of the web former is in the sector of the suction roll 14 starting from the point at which the inner wire 17 meets the outer circumference of the suction roll 14 for the first time, and ends at a short distance, preferably a few centimeters, from the pint at which the outer wire 15 is separated from the outer circumference of the suction roll 14. The second suction zone b on the suction roll 14 is in a sector that starts from the point at which the first suction zone a ends, and ends rights before the beginning of the pre-press and transfer nip $NP_0$.

In the suction zones a, b of the suction roll 14 of the web former and in the pre-press and transfer nip $NP_0$, water is drained from the web $W_0$ to such an extent that the dry solids content $\Delta k = k_1 - k_0$ of the web $W_1$ becomes about 7%–10% higher. After the pre-press and transfer nip $NP_0$, the dry solids content of the web $W_1$ is about 20% to about 30%. In the pre-press and transfer nip $NP_0$, a linear load of maximally about 100 kN per meter is used.

The first press zone $NP_1$ proper is preferably an extended-nip zone. In the extended nip $NP_1$, the lower roll is a hose roll 21 provided with a pressure-loaded press show 22, and the upper roll is a hollow-faced 23*a* press roll 23. The outer face of the belt mantle 21*a* on the roll 21 can be hollow or smooth. In some cases, it is possible to substitute for the extended-nip zone $NP_1$ by a corresponding roll nip.

In the first extended nip $NP_1$, water continues to be removed from the web $W_1$ in one direction only, i.e., in the extended nip $NP_1$ into the press felt 25 placed below the web $W_1$. In the extended nip $NP_1$, the dry solids content of the web $W_1$ becomes about 20% to about 30% higher. In the extended nip $NP_1$, maximally a linear load of about 1500 kN per meter is used.

After the first press zone $NP_1$, there follows at least a second press zone, after which the web W is transferred as a closed draw into the dryer section. The second press zone is not shown in the figures. With respect to the second and/or additional press zones following after the first press zone and the other parts includes in the press section, reference is made to the current assignee's Finnish Patent application No. 954698.

In the invention, an essential component is the transfer belt 24 which substantially does not receive water and is arranged in the manner described above. It is characteristic of this transfer belt 24 that it is substantially impermeable, i.e., either does not receive water at all or receives water just to a little extent. An important feature is also the capability of adhesion of the transfer belt 24 so that it can separate the web $W_0$ directly after the pre-press zone or equivalent without risk of rewetting. This capability of adhesion is partly based on the smooth or almost smooth outer face of the transfer belt 24 and on the choice of its material. The transfer belt 24 is substantially non-stretchable. As the material of the transfer belt 24, it is possible to use various synthetic materials, and it may be reinforced by means of a metal-composite or a fabric. The thickness of the transfer belt 24 is generally dimensioned in the range of from about 1 mm to about 5 mm so that it endures bending, compression pressures in the various nips, doctoring and cleaning by means of a high-pressure water jet. For example, the transfer belt sold with the Transbelt™ product name is suitable for this purpose.

Above, some preferred embodiments of the invention have been described, and it is obvious to a person skilled in the art that numerous modification can be made to these embodiments within the scope of the invention idea defined in the accompanying patent claims. As such, the examples provided above are not meant to be exclusive. Many other variations of the present invention would be obvious to those skilled in the art, and are contemplated to be within the scope of the appended claims.

What is claimed is:

1. A method for dewatering a paper or board web in a press section and passing the web as a closed draw from a lower wire of a web forming section having an upper and lower wire to the press section and through at least one press nip in the press section, comprising the steps of:

forming a pre-press and transfer nip between a suction roll situation in a loop of the lower wire and a smooth-faced press roll, arranging first and second suction zones in said suction roll, separating the web from said upper wire at said first suction zone of said suction roll such that the web is carried over said second suction zone of said suction roll only on the lower wire, carrying the web on the lower wire into said pre-press and transfer nip, guiding a non-water receiving transfer belt into and through said pre-press and transfer nip, said smooth-faced press roll being situated in a loop of said transfer belt, transferring the web from the lower wire to said transfer belt at said suction roll in said pre-press and transfer nip, carrying the web on said transfer belt into a first one of the at least one press nip in the press section, and guiding a water-receiving press felt into said first press nip and into contact with the web such that water is pressed out of the web in said first press nip and into said water-receiving press felt.

2. The method of claim 1, further comprising the step of:

constructing said pre-press and transfer nip such that a substantial amount of water is drained from the web primarily in one direction only through the lower wire into said suction roll and at the same time, the web is affixed reliably to an outer face of said transfer belt.

3. The method of claim 1, further comprising the steps of:

draining water from the web in said suction zones and in said pre-press and transfer nip until the dry solids content of the web is from about 20% to about 30%.

4. The method of claim 1, further comprising the step of:

selecting a radius of said suction roll and a radius of said smooth-faced press roll such that the radius of said smooth-faced press roll is smaller than the radius of said suction roll and a ratio of the radius of said suction roll to the radius of said smooth-faced press roll is from 2 to 5.

5. In a press section of a paper or board machine including a web forming section having a lower wire and an upper wire and at least one press nip for dewatering a web, the web being transferred into a first one of said at least one press nip as a closed draw from a lower wire of the web former section, the web being transferred between adjacent ones of said at least one press nip as a supported and closed draw, and the web being transferred after a last one of said at least one press nip to a dryer section as a closed draw, the improvement comprising:

a pre-press and transfer nip defined by a suction roll arranged in a loop of the lower wire and a smooth-faced press roll, said suction roll having first and second suction zones arranged one after another, said web being separated from said upper wire at said first suction zone of said suction roll and carried only by said lower wire over said second suction zone, the web being carried on the lower wire into said pre-press and transfer nip, and a substantially non-water-receiving transfer belt having an outer face to which the web is adherable, said transfer belt being guided into the through said pre-press and transfer nip such that the web is transferred from the lower wire onto said outer face of said transfer belt at said suction roll in said pre-press and transfer nip and separates from the lower wire after said pre press and transfer nip to avoid rewetting of the web, the web being carried on said transfer belt into and through the first press nip in the press section.

6. The press section of claim 5, wherein said first suction zone is situated in a sector which starts from a point at which, in a running direction of the web, the lower wire initially contacts said suction roll and ends at a short distance from a point at which the upper wire is separated from the web, said second suction zone being situation in a sector which starts from a point at which said first suction zone ends, and ends directly before said pre-press and transfer nip.

7. The press section of claim 5, further comprising a water receiving press felt which is guided into contact with the web and into the first press nip such that water is pressed out of the web in the first press nip and into the water receiving press felt.

8. The press section of claim 5, wherein said smooth-faced press roll has a radius smaller than a radius of said suction roll such that a ratio of the radius of said suction roll to the radius of said smooth-faced press roll is from 2 to 5.

9. In a paper or board machine including a web former section including an upper wire, a lower wire and means for forming a web between said upper and lower wires, a press section arranged after said web former section for dewatering the web, and a dryer section arranged after said press section for drying the web, the web being transferred from said press section into said dryer section in a closed draw, the improvement comprising:

said press section including a pre-press and transfer nip defined by a suction roll arranged in a loop of said lower wire and a smooth-faced press roll, said suction roll having first and second suction zones, the web being separated at said first suction zone of said suction roll from the upper wire and the web being carried on the lower wire over said second suction zone of said suction roll, the web being carried on the lower wire into said pre-press and transfer nip, a substantially non-water-receiving transfer belt having an outer face to which the web is adherable, said transfer belt being guided into and through said pre-press and transfer nip such that the web is transferred at said suction roll in a closed draw from said lower wire onto said outer face of said transfer belt in said pre-press and transfer nip and separates from said lower wire after said pre-press and transfer nip to avoid rewetting of the web, and at least one press nip for dewatering the web, the web being carried in a closed draw on said transfer belt into a first one of said at least one press nip in a running direction of the web and between adjacent ones of said at least one press nip in a closed draw.

10. The paper or board machine of claim 9, wherein said first suction zone is situated in a sector which starts from a point at which, in a running direction of the web, said lower wire initially contacts said suction roll and ends at a short distance from a point at which said upper wire is separated from the web, said second suction zone being situated in a sector which starts from a point at which said first suction zone ends, and ends directly before said pre-press and transfer nip.

11. The paper or bard machine of claim 9, further comprising a water-receiving press felt which is guided into contact with the web and into the first press nip such that water is pressed out of the web in the first press nip and into said water receiving press felt.

12. The paper or board machine of claim 9, wherein said smooth-faced press roll has a radius smaller than a radius of said suction roll such that a ratio of the radius of said suction roll to the radius of said smooth-faced press roll is from 2 to 5.

* * * * *